US009399233B2

(12) United States Patent
Mitomo et al.

(10) Patent No.: US 9,399,233 B2
(45) Date of Patent: Jul. 26, 2016

(54) BELL CUP FOR A ROTARY ATOMIZING TYPE ELECTROSTATIC COATING DEVICE

(71) Applicants: Nissan Motor Co., Ltd., Yokohama-shi, Kanagawa (JP); Keio University, Minato-ku, Tokyo (JP)

(72) Inventors: Hiroyuki Mitomo, Isehara (JP); Tatsuki Kurata, Sagamihara (JP); Shirou Ota, Fujisawa (JP); Shou Sakai, Yokohama (JP); Kouichi Asakura, Yokohama (JP); Kazuyuki Shizawa, Yokohama (JP); Hideo Sugawara, Musashino (JP)

(73) Assignees: Nissan Motor Co., Ltd., Yokohama (JP); Keio University, Tokyo (JP)

( * ) Notice: Subject to any disclaimer, the term of this patent is extended or adjusted under 35 U.S.C. 154(b) by 0 days.

(21) Appl. No.: 14/428,536

(22) PCT Filed: Sep. 20, 2013

(86) PCT No.: PCT/JP2013/075465
§ 371 (c)(1),
(2) Date: Mar. 16, 2015

(87) PCT Pub. No.: WO2014/054438
PCT Pub. Date: Apr. 10, 2014

(65) Prior Publication Data

US 2015/0273497 A1 Oct. 1, 2015

(30) Foreign Application Priority Data

Oct. 1, 2012 (JP) ..... 2012-219084

(51) Int. Cl.
*B05B 5/04* (2006.01)
*B05B 3/10* (2006.01)

(52) U.S. Cl.
CPC ..... *B05B 5/0407* (2013.01); *B05B 5/0426* (2013.01)

(58) Field of Classification Search
CPC .. B05B 3/1007; B05B 3/1014; B05B 3/1064; B05B 5/04; B05B 5/0403; B05B 5/0407; B05B 5/0426
See application file for complete search history.

(56) References Cited

U.S. PATENT DOCUMENTS 2,764,712 A 9/1956 Juvinall
4,985,283 A 1/1991 Ogata et al.
(Continued)

FOREIGN PATENT DOCUMENTS

DE 177045 C 8/1964
EP 1 250 961 A1 10/2002
FR 2887472 A1 12/2006
(Continued)

*Primary Examiner* — Darren W Gorman
(74) *Attorney, Agent, or Firm* — Global IP Counselors, LLP

(57) ABSTRACT

A bell cup includes an inner surface and a coating material diffusion surface on the inner surface of the bell cup. The coating material diffusion surface includes a first range extending from an end part of the coating material diffusion surface to a center part of the coating material diffusion surface, the end part being disposed toward a proximal end of the bell cup, being a convex curved surface facing towards the rotation axis, and on which, in a cross section of any plane that includes the rotation axis, normal line components of a centrifugal force acting on a coating material liquid film due to rotation of the bell cup are substantially equal, and a second range extending from the center part to a distal end edge of the bell cup, and being a being a concave curved surface facing towards the rotation axis.

6 Claims, 15 Drawing Sheets

(56) References Cited

U.S. PATENT DOCUMENTS

| | | | | |
|---|---|---|---|---|
| 5,934,574 | A | 8/1999 | van der Steur | |
| 6,557,781 | B2 * | 5/2003 | Kon | B05B 3/1064 239/104 |

FOREIGN PATENT DOCUMENTS

| | | | |
|---|---|---|---|
| GB | 887450 | A | 1/1962 |
| JP | 57-174170 | A | 10/1982 |
| JP | 62-216670 | A | 9/1987 |
| JP | 09-234393 | A | 9/1997 |
| JP | 10-52657 | A | 2/1998 |
| JP | 2000-202328 | A | 7/2000 |
| JP | 2002-224593 | A | 8/2002 |
| JP | 3557802 | B2 | 5/2004 |

* cited by examiner

COMPARATIVE EXAMPLE 2

WORKING EXAMPLE 1

WORKING EXAMPLE 2

WORKING EXAMPLE 1

BELL CUP FOR A ROTARY ATOMIZING TYPE ELECTROSTATIC COATING DEVICE

CROSS-REFERENCE TO RELATED APPLICATIONS

This application is a U.S. National stage application of International Application No. PCT/JP2013/075465, filed Sep. 20, 2013, which claims priority to Patent Application No. 2012-219084 filed on Oct. 1, 2012, the contents of each of which are hereby incorporated herein by reference.

BACKGROUND

1. Field of the Invention

The present invention relates to a bell cup for a rotary atomizing electrostatic coating apparatus.

2. Background Information

In a rotary atomizing electrostatic coating apparatus employed in middle coat coating or top coat coating in a coating process for an automobile body, it is known for at least a portion of the coating material diffusion surface of the inner surface of the bell cup to be formed by a curved surface of convex shape towards the rotation axis of the bell cup, to thereby promote fine particle formation by the coating material, increasing the coating efficiency (Japanese Patent Publication No. 3557802).

SUMMARY

However, while the bell cup of the aforedescribed background art does provide the coating material with a small average particle diameter, the standard deviation of the particle diameter distribution is large, and during the coating of metallic coating materials at a high ejection rate/wide pattern, diminished orientation of lustrous pigments can occur.

An object of the invention is to provide a bell cup for a rotary atomizing electrostatic coating apparatus, which promotes fine particle formation by coating materials, and with which the average particle diameter can be made smaller, while at the same time achieving a smaller standard deviation of the particle diameter distribution.

The present invention solves the aforedescribed problem by forming the coating material diffusion surface of the bell cup at the proximal end side thereof as a convex curved surface towards the rotation axis, and at the distal end side thereof as a convex curved surface towards the rotation axis.

At the proximal end side of the bell cup at which the coating material is supplied, the coating material liquid film on the coating material diffusion surface is thicker, and inertial force produced by rotation of the bell cup predominates, whereas at the distal end side of the bell cup from which the coating material is discharged, the coating material liquid film on the coating material diffusion surface is thinner, and the viscous force of the coating material predominates.

On the basis of this discovery, in the present invention, the coating material diffusion surface at the proximal end side of the bell cup is constituted by a convex curved surface by which the forces pressing the coating material liquid film against the coating material diffusion surface can be equalized, whereby the coating material liquid film can be uniformly diffused. On the other hand, the coating material diffusion surface at the distal end side of the bell cup is formed by a concave curved surface by which the forces discharging the coating material liquid film along the coating material diffusion surface can be equalized, whereby the coating material liquid film can be uniformly diffused.

In so doing, the occurrence, on the coating material diffusing surface, of a flow pattern which is a spiral flow or one with fingering can be minimized, and a uniform quantity of the coating material discharged about the entire circumference at the distal end edge of the bell cup. As a result, the average particle diameter of atomized coating particles can be smaller, while at the same time making the standard deviation of the particle diameter distribution smaller.

BRIEF DESCRIPTION OF THE DRAWINGS

Referring now to the attached drawings which form a part of this original disclosure.

DETAILED DESCRIPTION OF EMBODIMENTS

Figure 1:
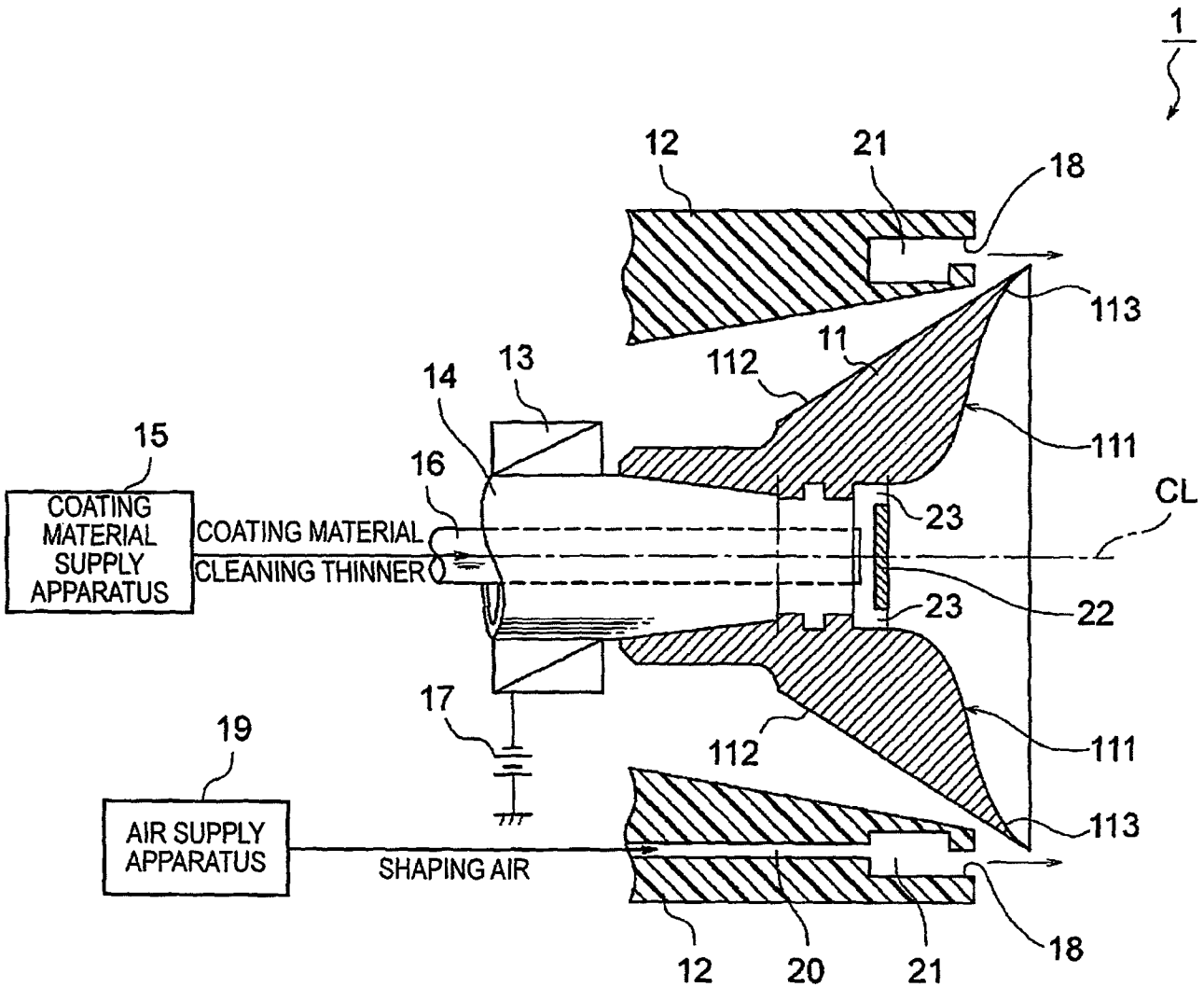
FIG. 1 is a cross-sectional view illustrating a distal end part of a rotary atomizing electrostatic coating apparatus in which the bell cup according to a first embodiment of the present invention is applied.

The embodiments of the present invention are described below on the basis of the drawings. FIG. 1 is a cross sectional view showing a distal end part of a rotary atomizing electrostatic coating apparatus 1 in which a bell cup 11 (also known as an atomization head or spray head, but herein referred to as a "bell cup") according to a first embodiment of the present invention is applied. An example of the rotary atomizing electrostatic coating apparatus 1 shall be described first, making reference to FIG. 1. The bell cup of the present invention is not limited only the structure of the rotary atomizing electrostatic coating apparatus 1 described hereinbelow, and may be applied to rotary atomizing electrostatic coating apparatuses having other structures as well.

The rotary atomizing electrostatic coating apparatus 1 shown in the drawing (hereinafter also referred to as an "electrostatic coating apparatus," or simply as "coating apparatus 1") has a hollow shaft 14 rotated by an air motor 13 which is disposed inside a housing 12 formed from an electrically insulating material. The bell cup 11 for spraying the coating material is fastened by a screw or the like to the distal end of the hollow shaft 14, and is driven so as to rotate together with the hollow shaft 14. In the center bore of the hollow shaft 14 is arranged a non-rotating hollow feed tube 16 for supplying the bell cup 11 with a coating material or cleaning thinner supplied by a coating material supply apparatus 15, and the outside periphery of the back surface of the bell cup 11 is covered by the distal end of a housing 12.

In the electrostatic coating apparatus 1, coating material particles which have been charged through application of voltage from a high-voltage power supply 17 travel airborne along an electrostatic field formed between the apparatus and an article to be coated, and are coated onto the article to be coated. The article to be coated is situated a prescribed gun distance away to the right side in FIG. 1, and is grounded via a coating carriage or coating hanger. As a high-voltage application system, an internal application type as shown in FIG. 1 can be adopted, in which a high-voltage power supply 17 is disposed within the housing 12, and voltage is applied, via the hollow shaft 14 formed by electrically conductive material, to the bell cup 11 formed of the same electrically conductive material. Alternatively, when the bell cup 11 is formed of electrically insulating material, an electrostatic coating apparatus of an external application type can be adopted, in which a discharge electrode connected to a high-voltage power supply is disposed surrounding the bell cup 11, and voltage is applied to the airborne traveling coating particles flying out from the bell cup 11.

Additionally, in the electrostatic coating apparatus 1, an air flow, known as "shaping air," is discharged from the back surface side of the bell cup 11 from air ejection ports 18, and the coating material particles rendered fine in size by the bell cup 11 are deflected in a direction towards the article being coated, which is situated to the front of the bell cup 11. Accordingly, an air passage 20 connected to an air supply apparatus 19 is formed in a portion of the housing 12, and an annular air passage 21 communicating with the air passage 20 is formed at the distal end of the housing 12. The air ejection ports 18, which communicate with the annular air passage 21, are formed at multiple locations at prescribed spacing along the distal end circumferential surface of the housing 12. By adjusting the flow rate and blowing angle of shaping air blown from the air ejection ports 18, the direction of airborne travel of the airborne stream of coating material particles flying out in a tangential direction from the distal end of the bell cup 11, i.e., the coating pattern, can be controlled. The coating material particles are moreover imparted with kinetic momentum by the shaping air, in addition to the force imparted thereto by the aforementioned electrostatic field. While air ejection ports 18 for the shaping air shown in FIG. 1 have been disposed in a single annular row, multiple rows may be disposed, in order to adjust the blowing angle of the shaping air.

The distal end of the feed tube 16 is exposed from the distal end of the hollow shaft 14, and extends towards the interior of the bell cup 11. The feed tube 16 is supplied by the coating material supply apparatus 15 with the coating compound or with a cleaning thinner, which is supplied from the distal end thereof to a coating material diffusion surface 111 of the bell cup 11. The cleaning thinner is a cleaning solution (in the case of an organic solvent-based coating material, an organic solvent, or in the case of a water-based coating material, water) for cleaning the coating material diffusion surface 111 of the bell cup 11, and a hub 22, discussed later, and in cases in which the coating apparatus 1 of the present example is employed in a top coat coating process or middle coat coating process requiring a color switching procedure, is supplied for cleaning purposes at times of color change of the coating material. Consequently, in coating processes in which color switching procedure are not needed, for example, in a middle coat coating process involving coating with only a single type of middle coat coating material, it is acceptable for the feed tube 16 to be supplied with the coating material only. Color switching procedures are carried out by a color switching valve unit, such as a color change valve or the like, not illustrated, which is included in the coating material supply apparatus 15.

The bell cup 11 is generally cup shaped, and in the present example is formed from electrically conductive material such as a metal or the like, and has the coating material diffusion surface 111 of the cup-shaped inner surface, a cup-shaped outer surface 112, and a distal end edge 113 situated at the distal end of the inner surface, at which the coating material is discharged. The hub 22 is attached to the distal end of the feed tube 16, at the center on the proximal end side of the bell cup 11. This hub 22 can be formed of an electrically conductive material such as metal, or of an electrically insulating material. The hub 22 is installed on the distal end of the hollow shaft 14 or the proximal end of the bell cup 11, and may be formed in such a way as to rotate in unison with the hollow shaft 14 or the bell cup 11, or installed on the distal end of the feed tube 16 and formed to be non-rotating. The bell cup 11 can be formed of electrically insulating material.

Because the bell cup 11 is circular in shape in plan view, the hub 22 is also circular in shape in plan view. A plurality of coating material ejection holes 23 are formed at prescribed spacing in an outside peripheral portion of the hub 22, and the coating material or cleaning thinner supplied from the distal end of the feed tube 16 passes through the coating material ejection holes 23 of the hub 22 and is guided onto the coating material diffusion surface 111 of the bell cup 11, then sprayed from the entire circumference of the distal end edge 113.

Next, the configuration of the coating material diffusion surface 111 of the bell cup 11 of the present example will be described.

Figure 2:
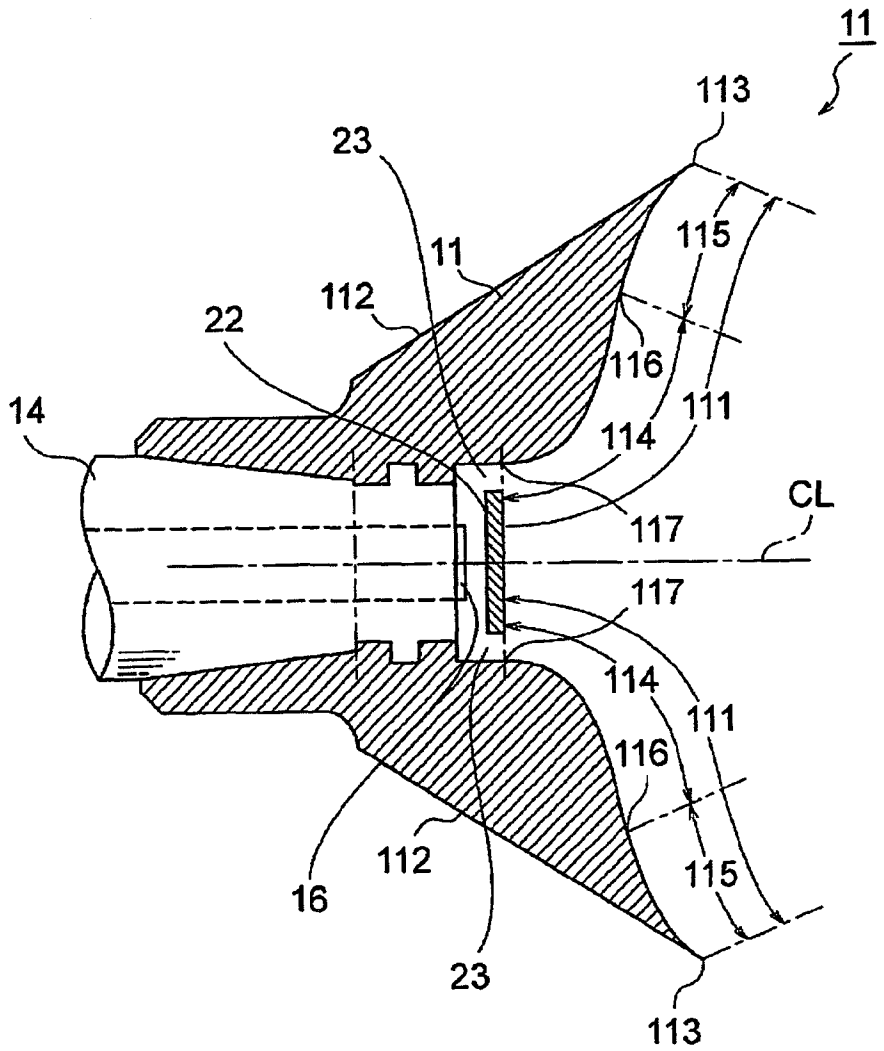
FIG. 2 is a cross-sectional view illustrating an enlargement of the bell cup of FIG. 1.

FIG. 2 is an enlarged cross sectional view of the bell cup 11 shown in FIG. 1. The bell cup 11 of the present example has the coating material diffusion surface 111, which is rotationally symmetric about a rotation axis CL of the hollow shaft 14. This coating material diffusion surface 111 is constituted by a continuous curved surface having as a start point 117 a location at the proximal end side of the bell cup 11 inner surface, specifically, that of the coating material ejection holes 23, and as the end point the location of the distal end edge 113 of the inner surface of the bell cup 11. The terms start point and end point generally represent points along the direction of flow of the coating material from the feed tube 16, meaning that the two ends of the coating material diffusion surface 111 are defined by the location 117 of the coating material ejection holes 23 and the distal end edge 113 of the inner surface of the bell cup 11.

Figure 3:
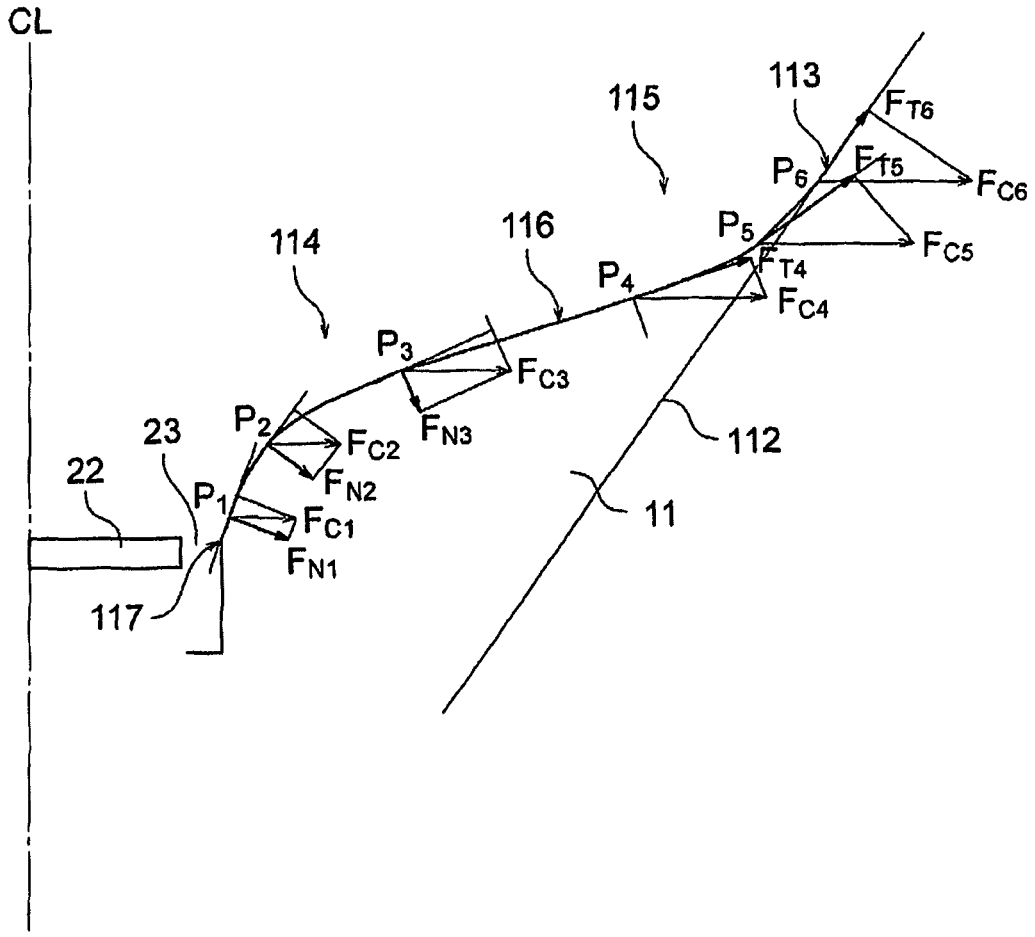
FIG. 3 is a diagram illustrating further enlargement of the coating material diffusion surface of the bell cup of FIG. 2.

In particular, in the coating material diffusion surface 111 of the present example, a first range 114 extending from the start point 117 corresponding to the coating material ejection holes 23 to an inflection point 116 in a center portion (an inflection curve of a plurality of inflection points aggregated in a circumferential direction, when the coating material diffusion surface 111 is viewed in a three-dimensional coordinate system) is constituted by a convex curved surface facing towards the rotation axis CL, and a second range 115 extending from the inflection point 116 to the distal end edge 113 of the bell cup 11 is constituted by a concave curved surface facing towards the rotation axis CL. FIG. 3 is a diagram showing further enlargement of the coating material diffusion surface 111 of the present example.

More specifically, the convex curved surface of the first range 114 is formed by a curved surface on which, in a cross section of any plane that includes the rotation axis CL of the hollow shaft 14, normal components $F_N$ of centrifugal force $F_C$ acting on the coating material liquid film due to rotation of the bell cup 11 are substantially equal. That is, as shown in FIG. 3, in the convex curved surface of the first range 114, where respective centrifugal force at arbitrary points $P_1$, $P_2$, $P_3$ . . . is denoted by $F_{C1}$, $F_{C2}$, $F_{C3}$ . . . , and where the horizontal distance from the rotation axis CL is denoted by r, the angular velocity by ω, and the mass of the coating material by m, the centrifugal force $F_{C1}$, $F_{C2}$, $F_{C3}$ . . . at the points $P_1$, $P_2$, $P_3$ . . . is given by $F_C=mr\omega^2$, and therefore the centrifugal force is lowest at the start point 117, with the centrifugal force increasing at locations increasingly closer to the inflection point 116. The convex curved surface of the first range 114 is constituted such that the centrifugal force normal components $F_{N1}$, $F_{N2}$, $F_{N3}$ . . . are such that $F_{N1}=F_{N2}=F_{N3}$.

That is, because the centrifugal force is lowest at the start point 117, and the centrifugal force is highest at the inflection point 116, to make the respective centrifugal force normal components substantially equal, the convex curved surface should be devised such that a tangent line of the coating material diffusion surface 111 at the start point 117 is parallel to the rotation axis CL, and such that tangent lines of the coating material diffusion surface 111 have increasingly larger angles with respect to the rotation axis CL, as one approaches closer towards the inflection point 116.

Here, the condition that the centrifugal force normal components satisfy the relationship $F_{N1}=F_{N2}=F_{N3}$ . . . is not intended to be a strict one, rather, to indicate generally a condition in which, substantially, $F_{N1}=F_{N2}=F_{N3}$ when mechanical machining accuracy of the bell cup 11 (e.g., ±5%) is included. As a specific general function for the convex curved surface of the first range 114, a logarithmic function can be cited, for example, represented by $y=a \log (x+b)+c$, where the rotation axis CL is designated as the Y axis, a radial direction of the bell cup 11 including the start point 117 which corresponds to the coating material ejection holes 23 is designated as the X axis, and a, b, and c are constants.

The concave curved surface of the second range 115 is formed by a curved surface on which, in a cross section of any plane that includes the rotation axis CL of the hollow shaft 14, tangent-line components of centrifugal force acting on the coating material liquid film due to rotation of the bell cup 11 are substantially equal. That is, as shown in FIG. 3, in the concave curved surface of the second range 115, where the respective centrifugal force at arbitrary points $P_4$, $P_5$, $P_6$ . . . is denoted by $F_{C4}$, $F_{C5}$, $F_{C6}$ . . . , and where the horizontal distance from the rotation axis CL is denoted by r, the angular velocity by ω, and the mass of the coating material by m, the respective centrifugal force $F_{C4}$, $F_{C5}$, $F_{C6}$ at the points $P_4$, $P_5$, $P_6$ . . . is calculated by $F_C=mr\omega^2$, and therefore the centrifugal force is lowest at the inflection point 116, with the centrifugal force increasing at locations increasingly closer to the distal end edge 113. The concave curved surface of the second range 115 is configured such that the centrifugal force tangent-line components $F_{T4}$, $F_{T5}$, $F_{T6}$ . . . satisfy the relationship $F_{T4}=F_{T5}=F_{T6}$.

That is, because the centrifugal force is lowest at the inflection point 116, and the centrifugal force is highest at the distal end edge 113, to make the respective centrifugal force normal components substantially equal, the concave curved surface should be devised to such that the angle of a tangent line of the coating material diffusion surface 111 with respect to the rotation axis CL is largest at the inflection point 116, and such that tangent lines of the coating material diffusion surface 111 have increasingly smaller angles with respect to the rotation axis CL as one approaches closer to the distal end edge 113.

Here, the condition that the centrifugal force tangent-line components satisfy the relationship $F_{T4}=F_{T5}=F_{T6}$ . . . is not intended to be a strict one, but generally indicates a condition in which, substantially, $F_{T4}=F_{T5}=F_{T6}$, when mechanical machining accuracy of the bell cup 11 (e.g., ±5%) is included. As specific general functions for the convex curved surface of the second range 115, an exponential function can be cited, for example, represented by $y=\alpha (e+\beta)^x+\gamma$, or a quadratic function represented by $y=\alpha \log (x+\beta)^2+\gamma$, where the rotation axis CL is designated as the Y axis, a radial direction of the bell cup 11 including the start point 117 which corresponds to the coating material ejection holes 23 is designated as the X axis, and α, β, and γ are constants.

On the coating material diffusion surface 111 of the bell cup 11 of the present embodiment, a boundary point 116 between the first range 114 and the second range 115 in a cross section of any plane that includes the rotation axis CL is properly a curved surface through which a convex curved surface and a concave curved surface are smoothly continuous, and is preferably formed by an inflection point 116 of a convex curved surface and a concave curved surface in the cross section. In this embodiment, the front and back faces including the boundary point may be planes (i.e., straight lines in cross section). The location of the inflection point 116 is set to an optimal one, depending on the qualities of the coating material.

Next, the operation will be described.

When coating an article to be coated with a coating material, the hollow shaft 14 and the bell cup 11 are rotated at high speed by the air motor 13. The coating material is supplied through the feed tube 16, to between the distal end part of the bell cup 11 and the hub 22. In this embodiment, due to centrifugal force produced by rotation of the bell cup 11, the supplied coating material travels from the plurality of coating material ejection holes 23 formed in an annular shape, to the start point 117 of the coating material diffusion surface 111, and from there towards the distal end edge 113, while becoming thinly drawn out along the coating material diffusion surface 111, and is discharged as a fine particle mist from the distal end edge 113. The discharged coating material particles tend to fly diametrically outward due to centrifugal force, but due to the shaping air jetted from the plurality of air ejection ports 18 disposed in an annular shape, the discharged coating material particles are controlled and shaped to the desired coating pattern so as to be narrow towards the front, and are transported towards the article to be coated. Simultaneously, because the coating material particles are electrically charged by the bell cup 11 due to the high voltage applied by the high-voltage power supply 17, the airborne traveling particles are directed towards the article to be coated, which is grounded, and are efficiently deposited on the surface of the article to be coated, by coulomb force.

In rotary atomizing electrostatic coating methods, enlarging the coating pattern and increasing the ejection rate (hereinafter also termed "high ejection rate/wide pattern") reduces the coating time, as compared to a smaller coating pattern. Specifically, the reason is that a region requiring two reciprocating passes of the coating operation in the case of coating in a narrow pattern can be covered in a single reciprocating pass, if coating is performed in a wide pattern. However, as compared to a narrow pattern, a high ejection rate is necessary in order to ensure a prescribed film thickness.

Figure 4:
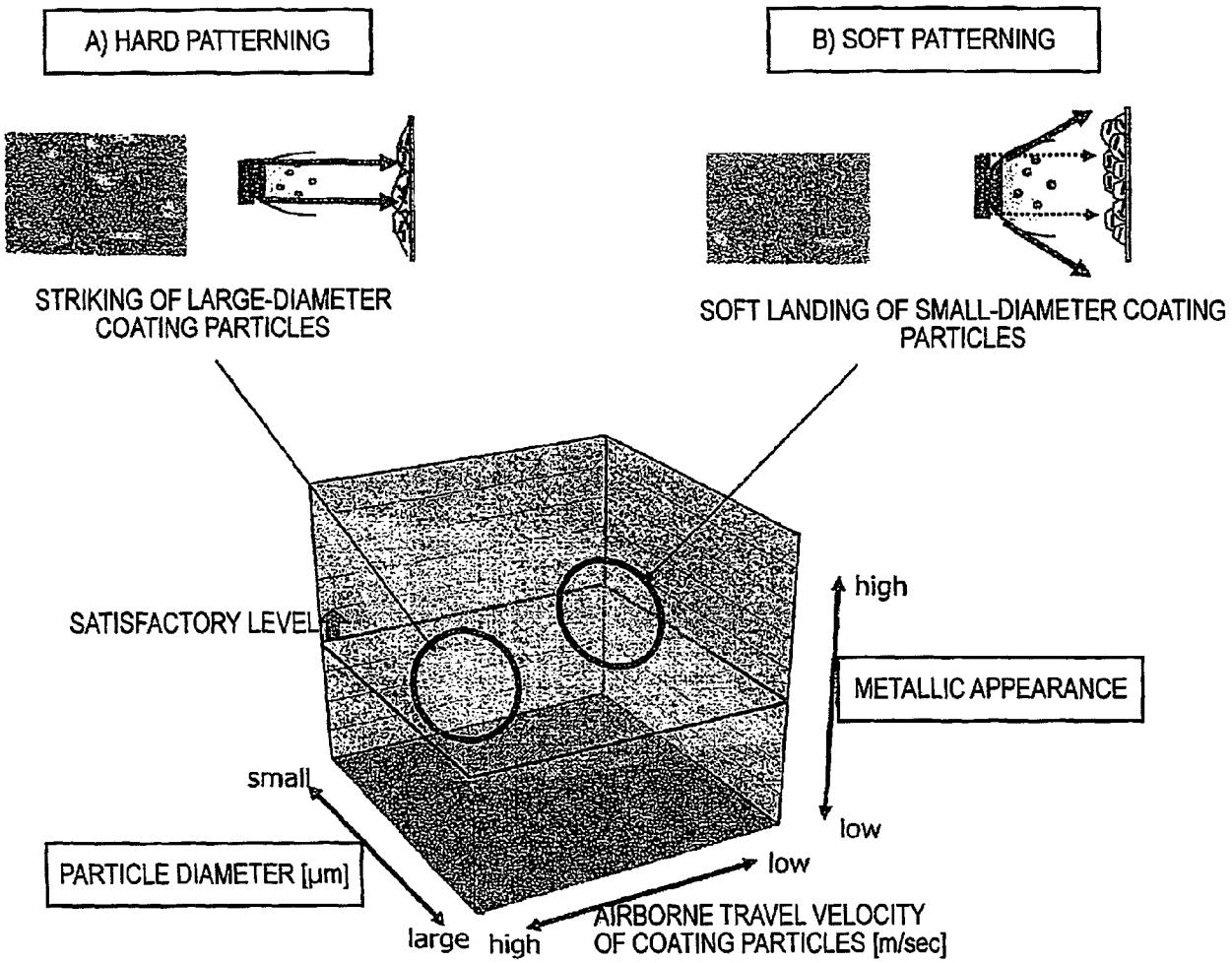
FIG. 4 is a diagram describing a method for producing uniform orientation of a lustrous material in a metallic coating.

On the other hand, the coating quality regarded as entailing the highest degree of difficulty is that of orienting a lustrous material in a metallic coating, as the orientation of a lustrous material must be uniform in order to reproduce the desired color. The reason is that, when the orientation of a lustrous material is not uniform, quality defects, whereby color differs by region, occur; and when reproducibility is poor, quality defects, whereby color differs by coated article, occur. Methods for achieving uniform orientation of a lustrous material include, as shown in FIG. 4: A) hard patterning, in which the airborne travel velocity of the coating particles is increased so as to strike the article to be coated and orient the lustrous material; and B) soft pattering, in which the coating particle diameter is reduced to the point that one particle of lustrous material is present for each particle of coating material, and the coating material is coated uniformly onto the article to be coated, bringing about orientation. In hard patterning, the airborne travel velocity of the coating particles is increased by increasing the flow rate of the shaping air.

As shown in the diagram at the bottom of FIG. 4, in either case, a characteristic value of target metallic appearance meets a satisfactory level, and the coating methods are effective for producing uniform orientation of a lustrous material in a metallic coating; however, as mentioned previously, adopting a wide pattern as the coating pattern in order to achieve a shorter coating step necessitates lowering the flow rate of the shaping air. Accordingly, due to the difficulty of increasing the airborne travel velocity of the coating particles when the aforedescribed A) hard patterning is adopted, the aforedescribed B) soft patterning becomes a prerequisite for producing uniform orientation of a lustrous material. Specifically, in order to carry out high ejection rate/wide pattern coating and produce uniform orientation of a lustrous material in a metallic coating, it is necessary to produce a smaller coating particle diameter, i.e., to promote fine particle formation.

It is known that fine particle formation by a coating material is related to the circumferential velocity of the bell cup, specifically, that, due to the cup diameter and the rotation speed, a higher circumferential velocity promotes fine particle formation. However, when the cup diameter is too large, coating losses arise during coating of narrow regions, and therefore an unchanging limit is encountered. When rotation speed is increased, unchanging limits as to air motor capabilities and durability are encountered as well. The inventors therefore conducted painstaking research as to factors which, besides the circumferential velocity of the bell cup, could contribute strongly to promotion of fine particle formation, and elucidated the mechanism of coating film shape on the bell cup inner surface, perfecting a technique for the control thereof. The following description includes the action of the bell cup 11 of the present example.

Figure 5:
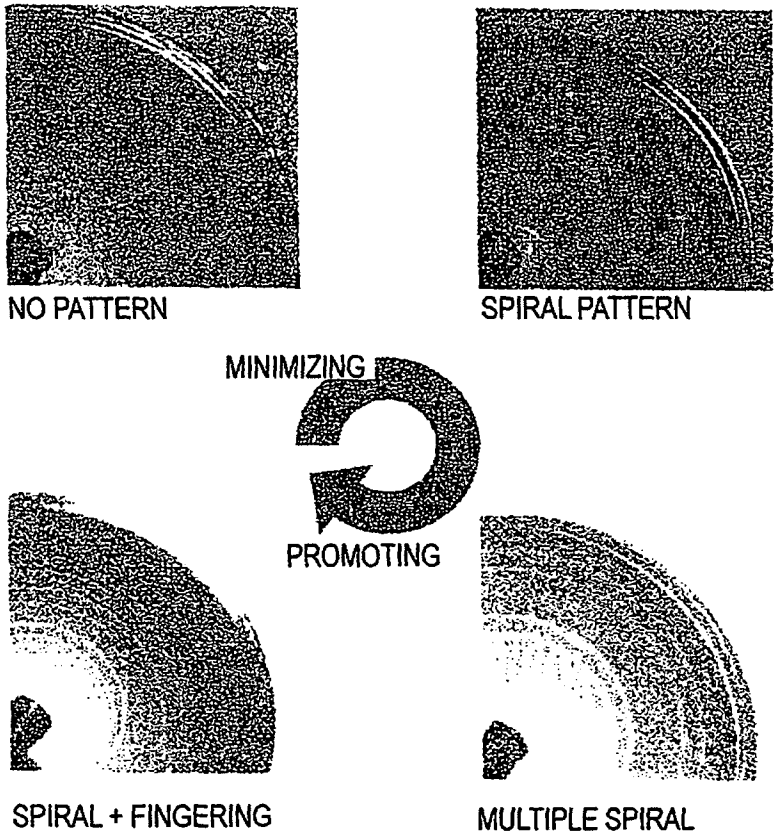
FIG. 5 is a diagram illustrating the condition of a coating material liquid film on the bell cup inner surface, observed at the laboratory level.

Firstly, for the purposes of verification on a laboratory level, a plurality of bell cups 11 having different inner surface shapes were prepared, and as shown in FIG. 5, while rotating the bell cups 11 at various rotation speeds, varying amounts of a coating material having unchanging properties, such as quality of material, viscosity, and the like, were dripped continuously onto the center of the inner wall thereof, and the state of diffusion of the liquid films thereof were captured with a high-speed camera. As a result, a state in which the liquid film pattern shown at upper left in the drawing appeared, a state in which the spiral flow shown at upper right appeared, a state in which the multiple spiral flow shown at lower right appeared, and a state in which, in addition to a multiple spiral flow, fingering as shown as lower left appeared, [were observed], confirming that, in addition to the bell cup rotation speed and the quantity of ejected coating material, the inner surface shape of the bell cup 11 is another factor promoting instability of the state of diffusion of liquid films.

Figure 6:
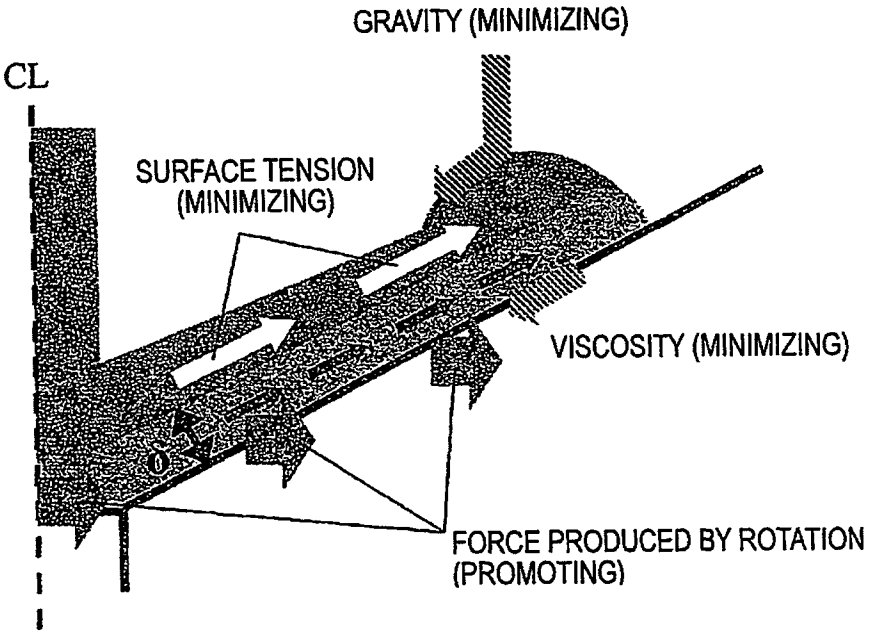
FIG. 6 is a diagram illustrating models of liquid film pattern phenomena that can be produced on a bell cup inner surface.

Thus, a phenomenological model for liquid film patterns produced on the inner surface of the bell cup 11 like that shown in FIG. 6 was conceived. As shown in the drawing, the coating material dripped continuously onto the center of the bell cup 11 reaches the bell edge while diffusing along the inner surface due to centrifugal force produced by rotation of the bell cup 11, and at this time the liquid film is acted upon by the centrifugal force produced by rotation, by viscous force with respect to the inner surface of the bell cup 11, by surface tension arising in the liquid film, and by gravity bearing on the liquid film. Of these, centrifugal force promotes instability of the state of diffusion of liquid films shown in FIG. 5, while the other factors of viscous force, surface tension, and gravity act in a direction of minimizing instability of the state of diffusion.

A liquid film subjected to centrifugal force (inertial force) is more strongly affected by viscous force as the proportion of a boundary layer $\delta$ increases, and instability of the state of diffusion of the liquid film is minimized as a result. Specifically, in proximity to the center of a bell cup 11, where the boundary layer $\delta$ proportion is low, the effects of centrifugal force are great, thereby promoting instability of the state of diffusion, but within a range close to the bell edge, where the boundary layer $\delta$ proportion is high, the influence of viscous force is stronger, minimizing instability of the state of diffusion. Consequently, it would be theoretically desirable to design the inner face shape such that the liquid film of the dripped coating material forms into a thin film very quickly in proximity to the center of the bell cup 11, and once the thin film has formed, a higher degree of viscous force is exerted.

Figure 7:
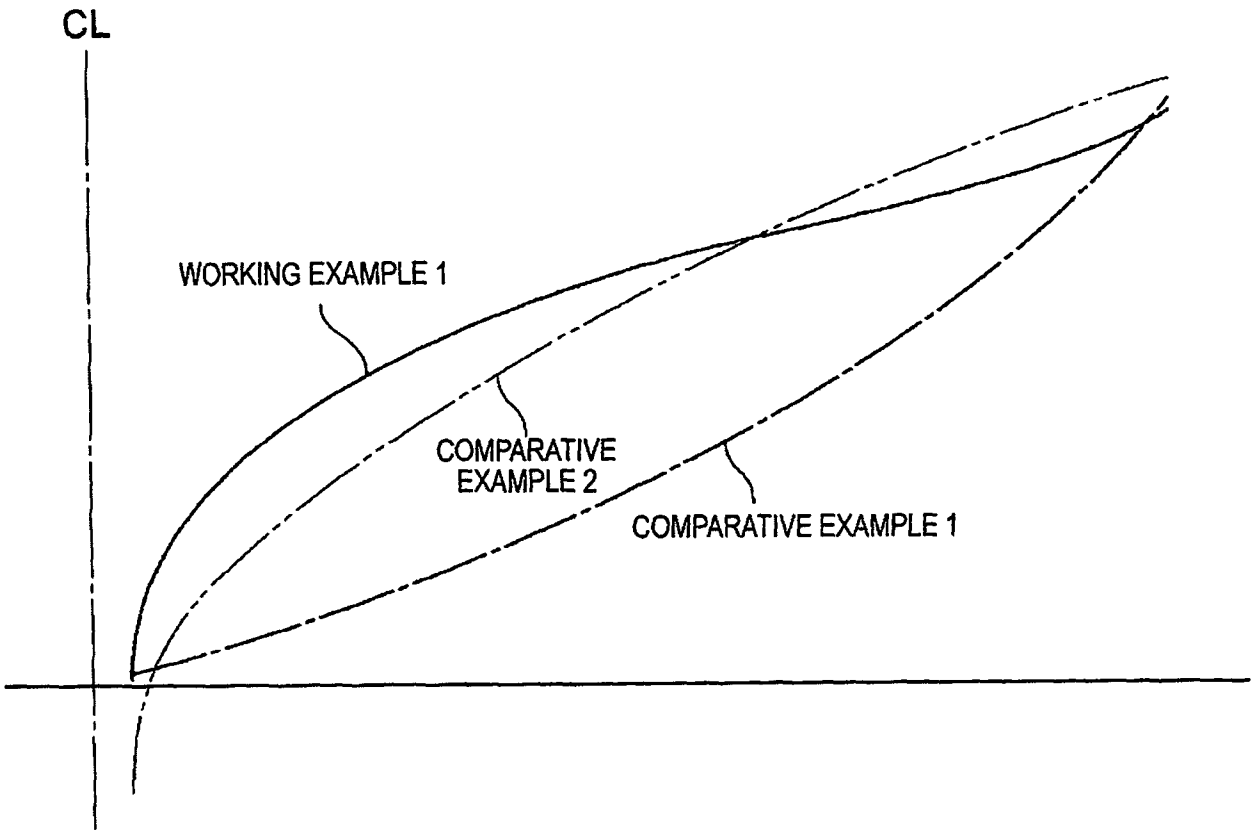
FIG. 7 is a diagram illustrating inner surface shapes of bell cups of Working Example 1, Comparative Example 1, and Comparative Example 2.

On the basis of the above discovery, with a view to optimizing the inner surface shape of the bell cup 11, Comparative Example 1 was prepared, in which the entire inner surface is a concave curved surface facing towards the rotation axis as in the prior art (corresponding to the structure of FIG. 6 of Japanese Patent Publication No. 3557802); Comparative Example 2, in which the entire inner surface is a convex curved surface facing towards the rotation axis (corresponding to the structure of FIG. 1 of Japanese Patent Publication No. 3557802); and Working Example 1 in which a first range extending from the end at the proximal end side to a center part of the inner surface is formed by a concave curved surface facing towards the rotation axis, and a second range extending from the center part to the distal end edge of the bell cup surface is constituted by a convex curved surface facing towards the rotation axis. These were installed in the actual rotary atomizing electrostatic coating apparatus 1 like that shown in FIG. 1, and the liquid film diffusion states produced on the coating material diffusion surface 111 were observed. The bell cup diameter was standardized to 70 mm. FIG. 7 shows the surface shape of the coating material diffusion surface to the right side of the rotation axis CL. When comparing the liquid film diffusion states of Working Example 1 and Comparative Examples 1 and 2, coating conditions other than the inner surface shape, the properties of the coating material (material quality, viscosity, and the like), the ejection rate, the bell cup diameter, and the rotation speed were all standardized to identical conditions.

Figure 8:
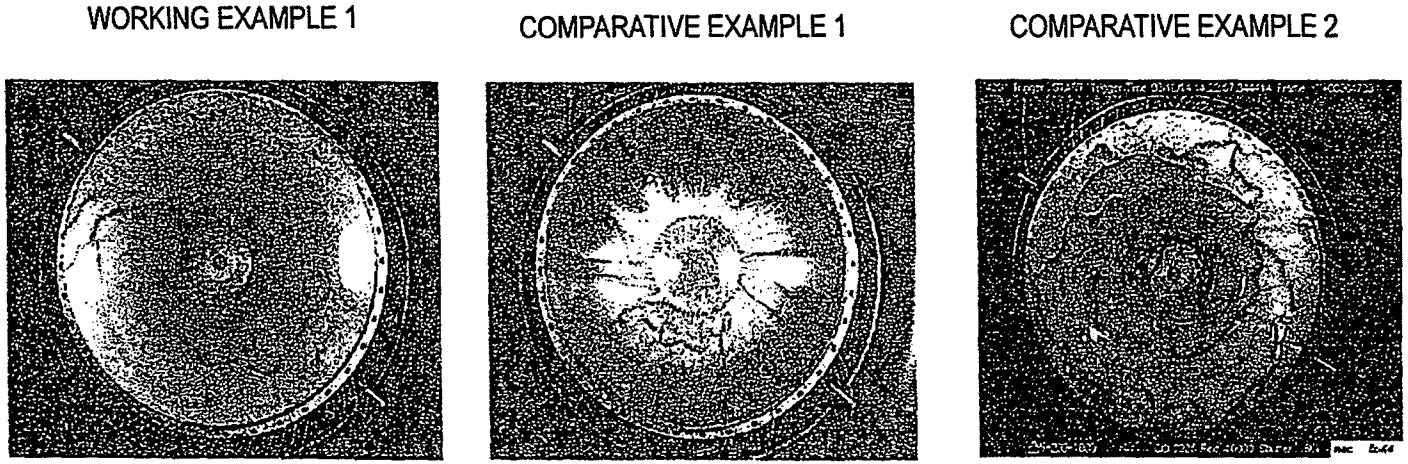
FIG. 8 is a diagram illustrating the condition of coating material liquid films on the inner surfaces of a bell cup installed in a rotary atomizing electrostatic coating apparatus.

FIG. 8 illustrates images captured by a high-speed camera, of liquid film diffusion states on the coating material diffusion surface when the coating material ejection rate is 100 cc/min, and the rotation speed is 1,000 rpm. It will be appreciated that, on the convex curved surface bell cup of Comparative Example 1, a streak-like liquid film pattern was observed in a radial direction, and there was a high degree of variability in the diameter of coating particles discharged from the bell edge. Additionally, it will be appreciated that, on the convex curved surface bell cup of Comparative Example 2, while no streak-like liquid film pattern like that of Comparative Example 1 was observed, liquid film patterns exhibiting fingering (or pleating) were observed, and there was variability in the diameter of coating particles discharged from the bell edge in this case as well. In contrast to this, with the convex curved surface-and-concave curved surface bell cup of Working Example 1, no streak-like liquid film pattern was observed, and the liquid film patterns were observed to have minimized levels of the fingering or pleating seen in Comparative Example 2.

Figure 9:
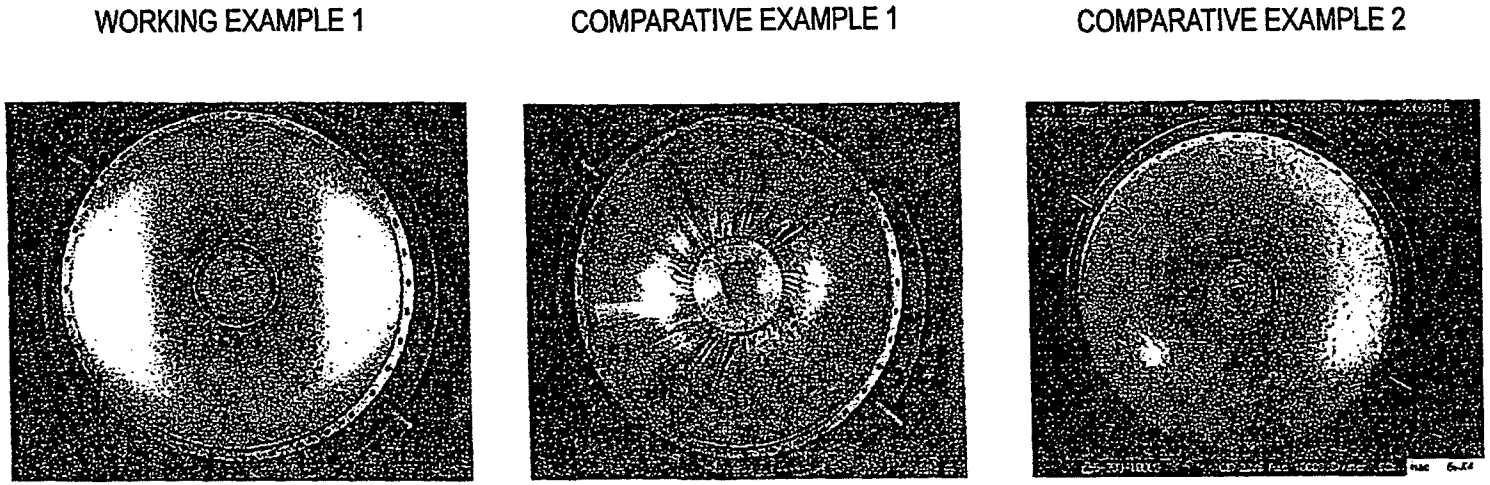
FIG. 9 is a diagram illustrating the condition of coating material liquid films on the inner surfaces of a bell cup installed in a rotary atomizing electrostatic coating apparatus.

FIG. 9 illustrates images captured by a high-speed camera, of liquid film diffusion states on the coating material diffusion surface when the coating material ejection rate is increased to 200 cc/min, and the rotation speed is increased to 10,000 rpm. It will be appreciated that, on the convex curved surface bell cup of Comparative Example 1, a liquid film pattern exhibiting radial streaks was observed, and there was still a high degree of variability in the diameter of coating particles discharged from the bell edge, albeit to a lesser extent than in Comparative Example 1 shown in FIG. 8. Additionally, it will be appreciated that, on the convex curved surface bell cup of Comparative Example 2, while no streak-like liquid film pattern like that of Comparative Example 1 was observed, liquid film patterns exhibiting fingering (or pleating) were still observed, and there was variability in the diameter of coating particles discharged from the bell edge in this case as well. In contrast to this, with the convex curved surface-and-concave curved surface bell cup of Working Example 1, no streak-like liquid film pattern was observed, and the liquid film patterns were observed to have extremely well-minimized levels of the fingering or pleating seen in Comparative Example 2.

Figure 10:
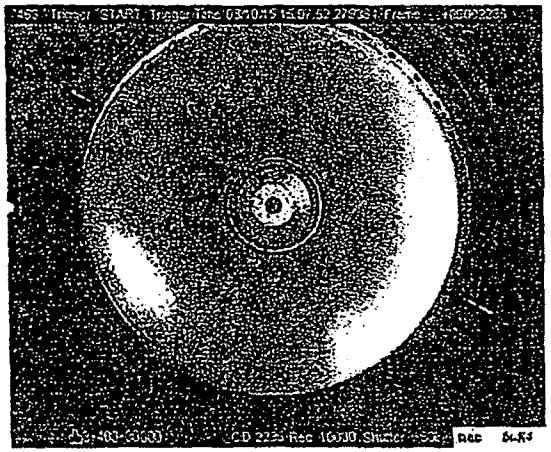
FIG. 10 is a diagram illustrating the condition of liquid films on the inner surfaces of a bell cup installed in a rotary atomizing electrostatic coating apparatus.
Figure 10:
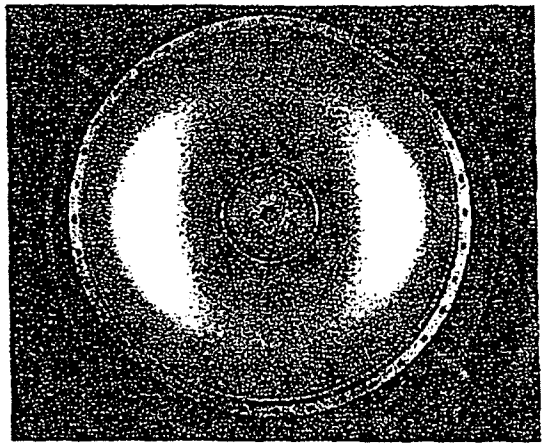

FIG. 10 illustrates images captured by a high-speed camera, of liquid film diffusion states on the coating material diffusion surface when the coating material ejection rate is further increased to 400 cc/min, and the rotation speed is increased to 30,000 rpm; the photos are of Working Example 1 and Working Example 2. The photo of Comparative Example 1 is omitted. In both instances, the liquid film pattern was minimized by increasing the rotation speed to 30,000 rpm; however, when Working Example 1 and Comparative Example 2 are compared, the liquid film pattern of Working Example 1 can be considered as being uniformly dispersed.

Figure 11:
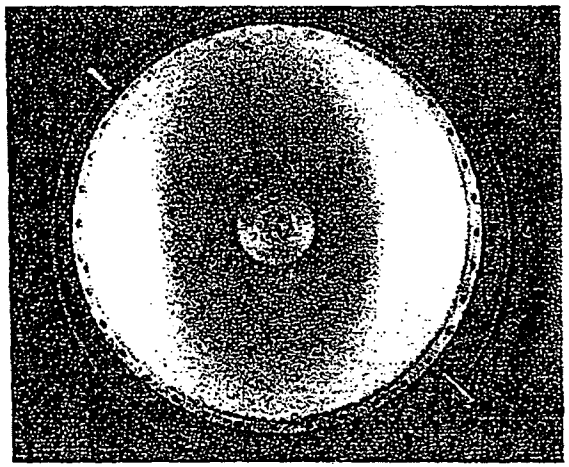
FIG. 11 is a diagram illustrating the condition of liquid films on the inner surfaces of a bell cup, produced by a water-based coating material and an organic solvent-based coating material.
Figure 11:
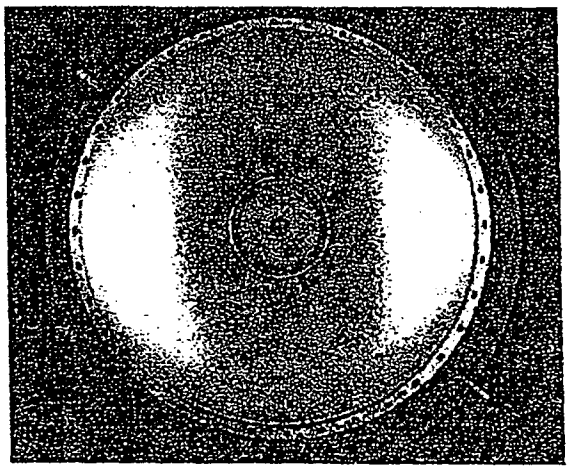

FIG. 11 illustrates images captured by a high-speed camera of liquid film diffusion states, in a case in which the coating material ejection rate is set to 200 cc/min and the rotation speed is set to 10,000 rpm, a water-based coating material was used as the coating material in Working Example 1, and an organic solvent-based coating material was used as the coating material in Working Example 2. In both Working Examples 1 and 2, the liquid film patterns were uniformly diffused, with no significant differences.

Figure 12:
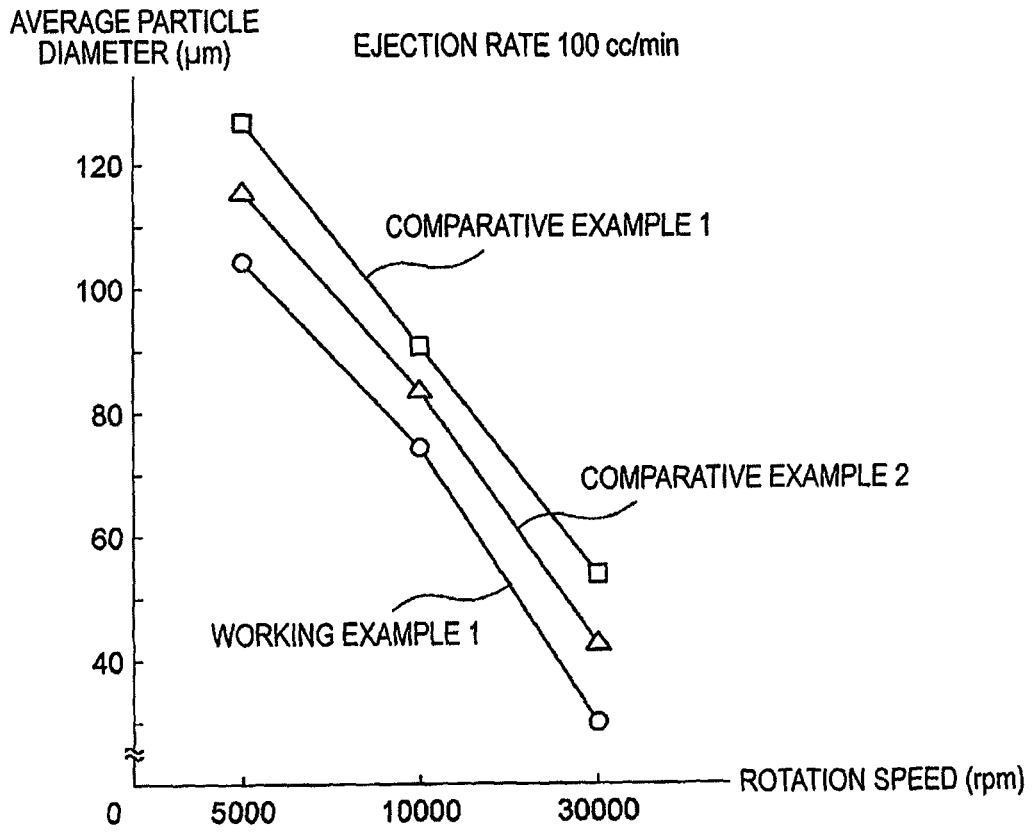
FIG. 12 is a graph illustrating the average particle diameter of fine particle formation, plotted against the rotation speed of the bell cups of Working Example 1 and Comparative Examples 1 and 2.
Figure 13:
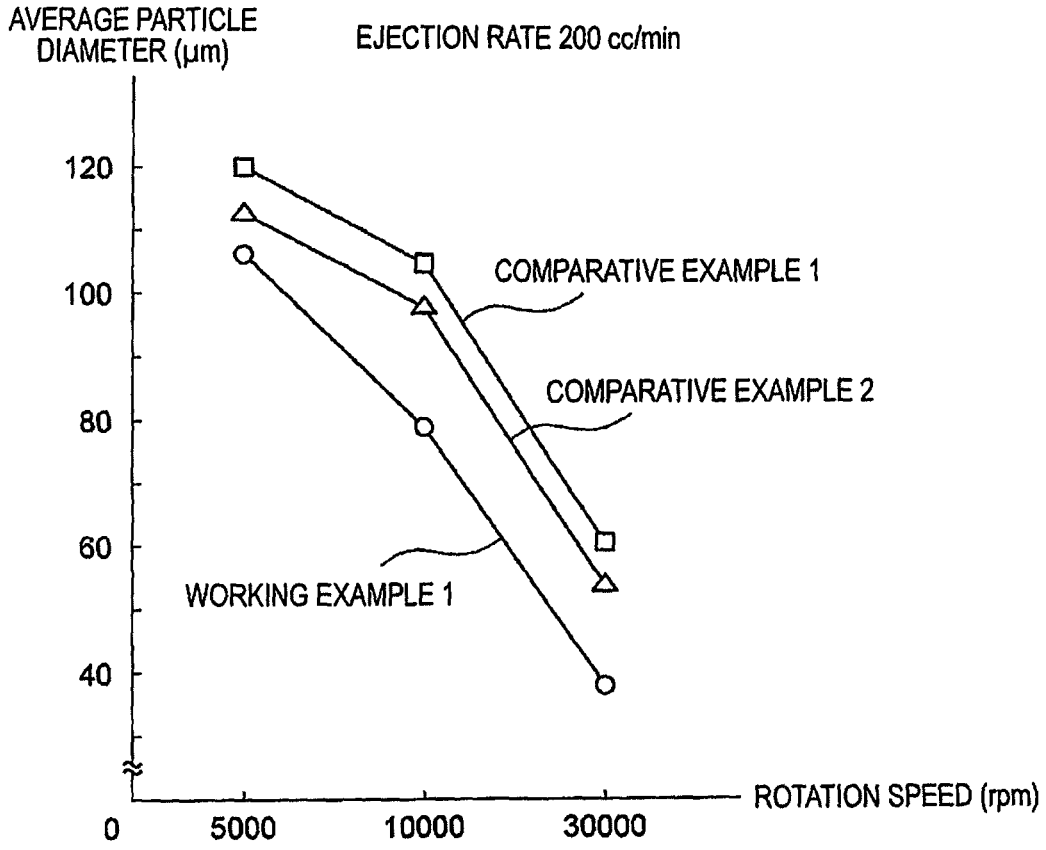
FIG. 13 is a graph illustrating the average particle diameter of fine particle formation, plotted against the rotation speed of the bell cups of Working Example 1 and Comparative Examples 1 and 2.
Figure 14:
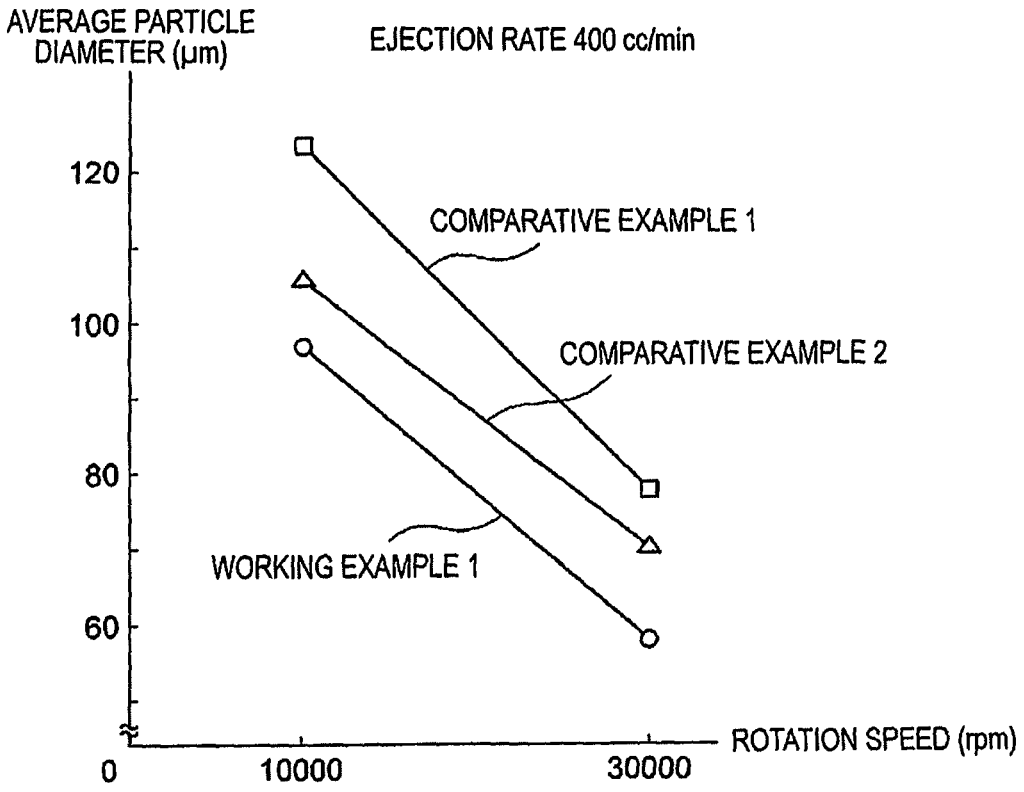
FIG. 14 is a graph illustrating the average particle diameter of fine particle formation, plotted against the rotation speed of the bell cups of Working Example 1 and Comparative Examples 1 and 2.

FIGS. 12 to 14 are graphs showing average particle diameter of fine particle formation, plotted against bell cup rotation speed in the aforedescribed Working Example 1 and Comparative Examples 1 and 2. FIG. 12 shows a case in which the coating material ejection rate was set to 100 cc/min, FIG. 13 one in which the coating material ejection rate was set to 200 cc/min, and FIG. 14 one in which the coating material ejection rate was set to 400 cc/min. It was confirmed that at each ejection rate, as long as the rotation speed was the same, the average particle diameter produced by the bell cup of Working Example 1 was smaller than the average particle diameter produced by the bell cups of Comparative Examples 1 and 2.

Figure 15:
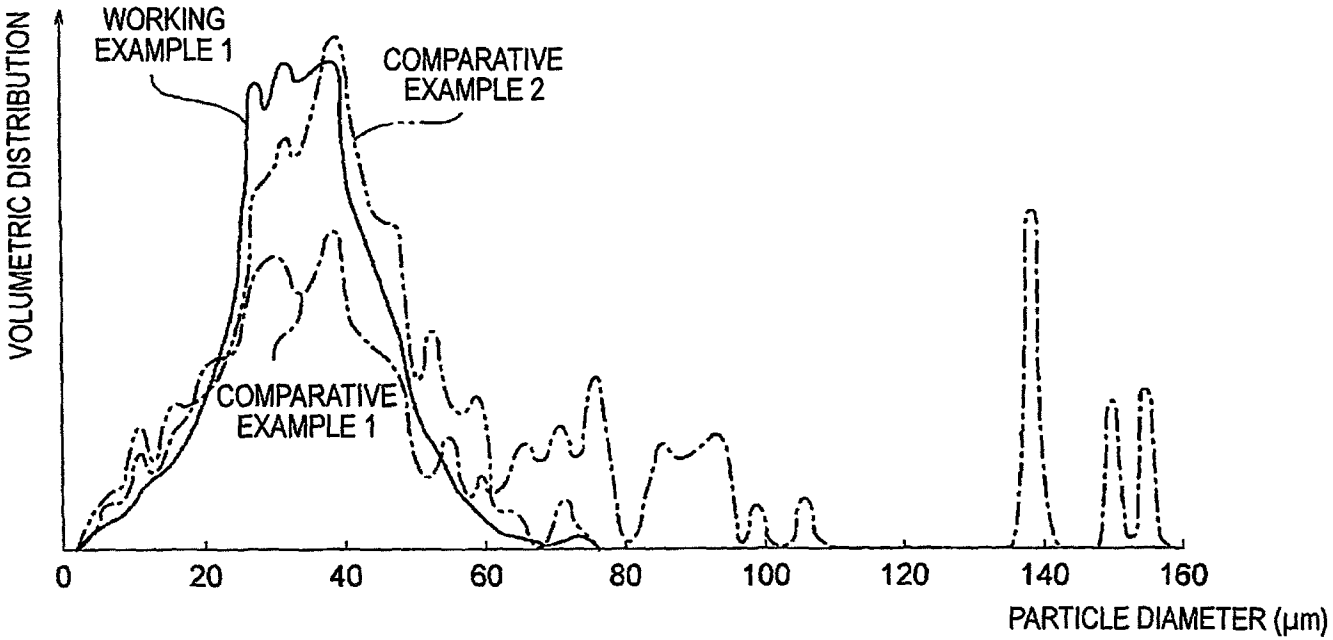
FIG. 15 is a graph illustrating the particle diameter distribution in Working Example 1 and Comparative Examples 1 and 2.

FIG. 15 is a graph showing the particle diameter distribution in Working Example 1 and Comparative Examples 1 and 2, and gives numerical values for a case in which the coating material ejection rate is set to 100 cc/min and the rotation speed is set to 3,000 rpm. In this example, the average particle diameter in Working Example 1 was 33.2 μm and the standard deviation thereof was 10.6, whereas the average particle diameter in Comparative Example 1 was 56.1 μm and the standard deviation thereof was 37.9, and the average particle diameter in Comparative Example 2 was 37.5 μm and the standard deviation thereof was 12.3. From these results, it was confirmed that, as compared with Comparative Example 2 in particular, the average particle diameter in Working Example 1 was smaller, and at the same time the standard deviation was smaller as well.

From the description above, it may be appreciated that at the proximal end side of the bell cup 11 where the coating material is supplied, the coating material liquid film on the coating material diffusion surface 111 is thick, and centrifugal force (inertial force) produced by rotation of the bell cup 11 predominates, whereas at the distal end side of the bell cup 11 at which the coating material is discharged, the coating material liquid film on the coating material diffusion surface 111 is thinner, and the viscous force of the coating material predominates. On the basis of this discovery, in the bell cup 11 of the present example, the coating material diffusion surface 111 at the proximal end side of the bell cup 11 is constituted of a convex curved surface such that the forces $F_N$ pressing the coating material liquid film against the coating material diffusion surface 111 can be equalized, whereby the coating material liquid film can be uniformly dispersed. On the other hand, the coating material diffusion surface 111 at the distal end side of the bell cup 11 is formed from a concave curved surface such that the forces $F_T$ discharging the coating material liquid film along the coating material diffusion surface can be equalized, whereby the coating material liquid film can be uniformly dispersed.

In so doing, the occurrence of flow patterns of spiral flow, streaks, or fingering on the coating material diffusion surface 111 can be minimized, and a uniform amount of coating material can be discharged from about the entire circumference of the distal end edge of the bell cup 11. As a result, the average particle diameter of the sprayed coating particles can be made smaller, and at the same time, the standard deviation of the particle diameter distribution can be made smaller.

By making the average particle diameter of the sprayed coating particles smaller and at the same time making standard deviation of the particle diameter distribution smaller, coating, particularly of metallic coating materials at a high ejection rate/wide pattern, becomes possible, and the coating process can be shortened, while maintaining or increasing the orientation of luminous material.

The invention claimed is:

1. A bell cup for installation on a rotary atomizing electrostatic coating apparatus, the bell cup having a rotation axis and comprising:

an inner surface; and a coating material diffusion surface on the inner surface of the bell cup, the coating material diffusion surface being supplied with a coating material, and including:

a first range extending from an end part of the coating material diffusion surface to a center part of the coating material diffusion surface, the first range being a convex curved surface facing towards the rotation axis, the end part being disposed toward a proximal end of the bell cup, and a tangent line to the diffusion surface at the end part being parallel to the rotation axis, and on the convex curved surface, in a cross section of any plane that includes the rotation axis, normal line components of a centrifugal force acting on a coating material liquid film due to rotation of the bell cup are substantially equal, and a second range extending from the center part to a distal end edge of the bell cup, and being a concave curved surface facing towards the rotation axis.

2. A bell cup for installation on a rotary atomizing electrostatic coating apparatus, the bell cup having a rotation axis and comprising:

an inner surface; and a coating material diffusion surface on the inner surface of the bell cup, the coating material diffusion surface being supplied with a coating material, and including:

a first range extending from an end part of the coating material diffusion surface to a center part of the coating material diffusion surface, the first range being a convex curved surface facing towards the rotation axis, the end part being disposed toward a proximal end of the bell cup, and a tangent line to the diffusion surface at the end part being parallel to the rotation axis, and a second range extending from the center part to a distal end edge of the bell cup, and being a concave curved surface facing towards the rotation axis, and on which, in a cross section of any plane that includes the rotation axis, tangent line components of a centrifugal force acting on a coating material liquid film due to rotation of the bell cup are substantially equal.

3. The bell cup according to claim 1, wherein the first range and the second range have a boundary point therebetween, and the boundary point, in a cross section of any plane that includes the rotation axis, is a point of inflection between the convex curved surface and the concave curved surface.

4. A bell cup for installation on a rotary atomizing electrostatic coating apparatus, the bell cup having a rotation axis and comprising:

an inner surface; and a coating material diffusion surface on the inner surface of the bell cup, the coating material diffusion surface being supplied with a coating material, and including:

a first range extending from an end part of the coating material diffusion surface to a center part of the coating material diffusion surface, the first range being a convex curved surface facing towards the rotation axis, the end part being disposed toward a proximal end of the bell cup, and a tangent line to the diffusion surface at the end part being parallel to the rotation axis, and on the convex curved surface, in a cross section of any plane that includes the rotation axis, normal line components of a centrifugal force acting on a coating material liquid film due to rotation of the bell cup are substantially equal, and a second range extending from the center part to a distal end edge of the bell cup, and being a concave curved surface facing towards the rotation axis, and on which, in a cross section of any plane that includes the rotation axis, tangent line components of the centrifugal force acting on a coating material liquid film due to rotation of the bell cup are substantially equal.

5. The bell cup according to claim 2, wherein the first range and the second range have a boundary point therebetween, and the boundary point, in a cross section of any plane that includes the rotation axis, is a point of inflection between the convex curved surface and the concave curved surface.

6. The bell cup according to claim 4, wherein the first range and the second range have a boundary point therebetween, and the boundary point, in a cross section of any plane that includes the rotation axis, is a point of inflection between the convex curved surface and the concave curved surface.

* * * * *